US011008953B2

(12) United States Patent
Desai et al.

(10) Patent No.: US 11,008,953 B2
(45) Date of Patent: May 18, 2021

(54) SYSTEMS AND METHODS FOR CYLINDER DEACTIVATION IN DEDICATED EGR ENGINE

(71) Applicant: Cummins Inc., Columbus, IN (US)

(72) Inventors: Akash S. Desai, Columbus, IN (US); David J. Langenderfer, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/709,306

(22) Filed: Dec. 10, 2019

(65) Prior Publication Data

US 2020/0256261 A1 Aug. 13, 2020

Related U.S. Application Data

(60) Provisional application No. 62/803,692, filed on Feb. 11, 2019.

(51) Int. Cl.

| | |
|---|---|
| ***F02D 13/06*** | (2006.01) |
| ***F02M 26/17*** | (2016.01) |
| ***F02D 41/38*** | (2006.01) |
| ***F02M 61/14*** | (2006.01) |
| ***F02M 35/10*** | (2006.01) |

(52) U.S. Cl.

CPC ..... *F02D 13/06* (2013.01); *F02D 41/38* (2013.01); *F02M 26/17* (2016.02); *F02M 35/10222* (2013.01); *F02M 61/14* (2013.01)

(58) Field of Classification Search

CPC ..... F02D 13/06; F02D 41/38; F02M 26/17; F02M 35/10222; F02M 61/14

USPC ..... 123/466

See application file for complete search history.

(56) References Cited

U.S. PATENT DOCUMENTS

| | | | | |
|---|---|---|---|---|
| 8,291,891 | B2 | 10/2012 | Alger, II et al. | |
| 9,284,920 | B2 | 3/2016 | Leone et al. | |
| 9,534,546 | B2 | 1/2017 | Nelson et al. | |
| 9,581,114 | B2 | 2/2017 | Hilditch et al. | |
| 9,599,046 | B2 | 3/2017 | Leone et al. | |
| 9,988,994 | B2 | 6/2018 | Leone et al. | |
| 10,513,992 | B1 * | 12/2019 | Gukelberger | F02M 26/43 |
| 2015/0114341 | A1 * | 4/2015 | Geckler | F02D 41/30 123/295 |
| 2017/0241364 | A1 * | 8/2017 | Sczomak | F01N 3/101 |

FOREIGN PATENT DOCUMENTS

| | | | | |
|---|---|---|---|---|
| WO | WO-2015055911 | A1 * | 4/2015 | F02D 41/0055 |
| WO | 2015066674 | | 5/2015 | |
| WO | WO-2015066674 | A1 * | 5/2015 | F02M 26/43 |

* cited by examiner

*Primary Examiner* — Mahmoud Gimie

(74) *Attorney, Agent, or Firm* — Taft Stettinius & Hollister LLP

(57) ABSTRACT

Systems, apparatus, and methods are disclosed that include a divided exhaust engine with at least one primary exhaust gas recirculation (EGR) cylinder and a plurality of non-primary EGR cylinders. The systems, apparatus and methods control the EGR fraction by deactivation of one or more of the cylinders.

19 Claims, 4 Drawing Sheets

SYSTEMS AND METHODS FOR CYLINDER DEACTIVATION IN DEDICATED EGR ENGINE

GOVERNMENT RIGHTS

This invention was made with Government support under DE-AC02-06CH11357 awarded by the Department of Energy. The Government has certain rights in this invention.

BACKGROUND

Engines operating with one or more cylinders as dedicated exhaust gas recirculation (EGR) cylinders can provide the entire EGR flow for the engine. The EGR flow can be provided to the intake manifold that feeds all the engine cylinders, including the dedicated EGR cylinder(s). Engines operating with one or more cylinders as dedicated EGR cylinders enjoy greatly simplified controls and pressure management, fewer hardware devices, and other benefits. However, these simplifications come at the cost of a loss of control over the system, including a loss of control of the EGR fraction. When cylinders are dedicated to providing EGR, and standard fueling and controls are applied, the EGR fraction provided by the cylinders is limited to the simple ratio of the number of EGR cylinders to the total number of cylinders. For example, an engine with one cylinder dedicated for EGR and four cylinders total will operate at a 25% EGR fraction if all of the cylinders are operated in the same manner. Additionally, an engine having dedicated EGR cylinders provides an opportunity for greater control over the temperature and composition of gases at the intake manifold, if a system could be developed to take advantage of this opportunity. Therefore, further technological developments are desirable in this area.

SUMMARY

The present disclosure includes a unique system, method and apparatus for a dedicated EGR engine and control of an EGR fraction. A dedicated or primary EGR cylinder(s), from which exhaust gas is recirculated to all the cylinders of the engine, provides the EGR flow for EGR fraction. One or more of the primary EGR cylinders and/or the non-primary EGR cylinders are deactivated in response to a cylinder deactivation condition and/or an EGR fraction deviation condition. The cylinder deactivation results in the closing of the intake and/or exhaust valves of the one or more deactivated cylinder(s) and/or the cutting off of fuel flow (and spark energy for spark ignited engines) to the one or more deactivated cylinders of the engine. Other embodiments include unique methods, systems, and apparatus to control an EGR fraction from one or more primary EGR cylinders of a divided exhaust engine to improve closed cycle efficiency and lower in-cylinder temperature in response to a cylinder deactivation condition.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
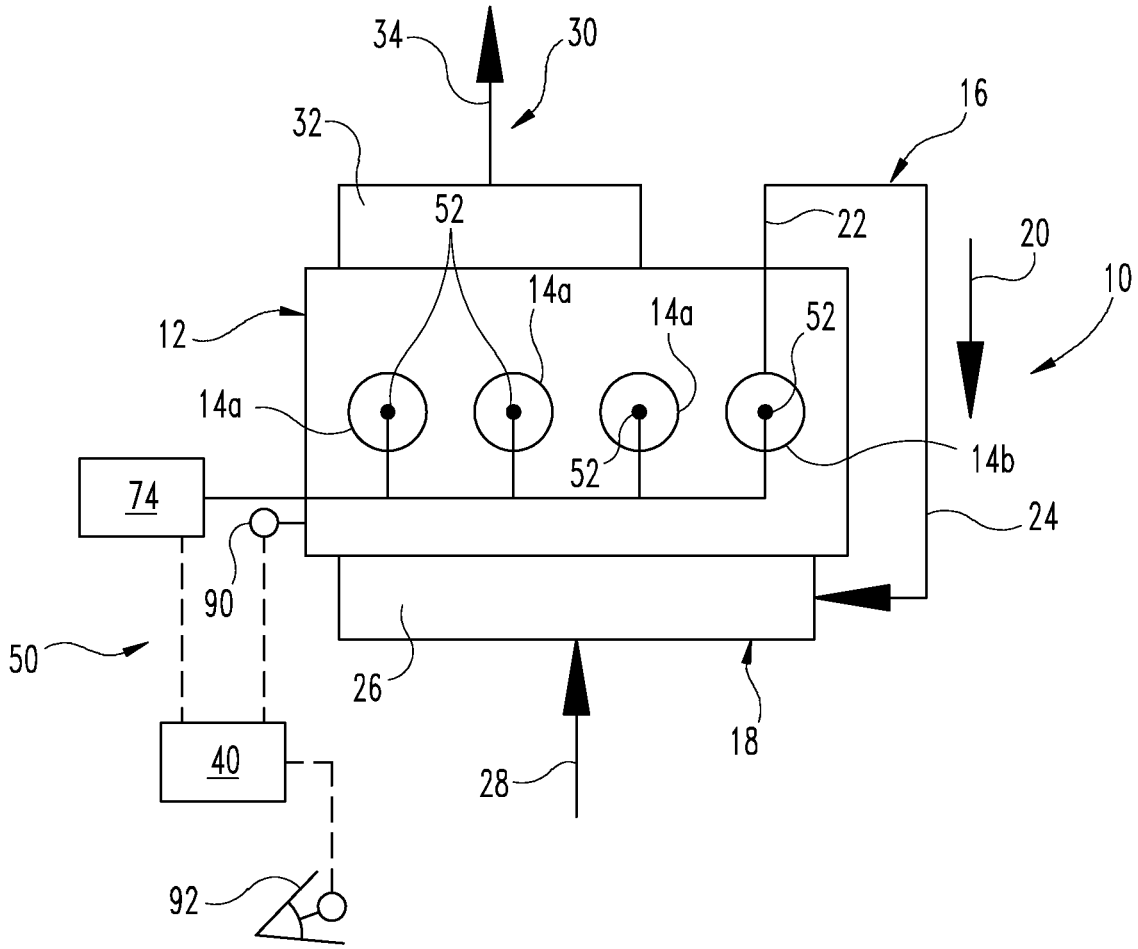
FIG. 1 is a schematic depiction of a system having an engine with primary EGR cylinders and additional non-primary or secondary cylinders that do not contribute to EGR flow at least under certain operating conditions.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referencing FIG. 1, a system 10 is depicted having an engine 12. The engine 12 is an internal combustion engine of any type, and can be a spark ignited or any type of compression ignition engine. In certain embodiments, the engine 12 may be any engine type producing emissions that may include an exhaust gas recirculation (EGR) system. The engine 12 includes a plurality of cylinders 14*a*, 14*b*. The number of cylinders 14*a*, 14*b* may be any number suitable for an engine, and the arrangement of cylinders may be in-line, V, or any suitable arrangement. The system 10 includes an inline 4 cylinder arrangement for illustration purposes only and is not limited to such.

The engine 12 includes primary EGR cylinders 14*b*, and other or remaining non-primary EGR cylinders 14*a*, that are secondary cylinders or not primary EGR cylinders 14*b*. Non-primary EGR cylinders 14*a* are completely flow isolated from the EGR system 16 in the illustrated embodiments on the exhaust side of the engine 12. The non-primary EGR cylinders 14*a* receive EGR flow and are flow connected to the primary EGR cylinders 14*b* on the intake side of the engine 12. In other embodiments, non-primary EGR cylinders 14*a* are connected to provide at least some exhaust flow to the EGR system 16 and/or receive exhaust flow from primary EGR cylinder 14*b* during certain operating conditions but are flow isolatable so the primary EGR cylinders 14*b* can be completely dedicated EGR cylinders. The term primary EGR, as utilized herein, includes any EGR arrangement wherein, during at least certain operating conditions, the entire exhaust output of certain one or more primary EGR cylinders 14*b* is recirculated to the engine intake system 18 is a primary EGR cylinder. A primary EGR cylinder typically, at least during primary EGR operation, includes exhaust divided from one or more of the remaining cylinders that are not primary EGR cylinders.

In the system 10, the EGR flow 20 from primary EGR cylinders 14*b* is collected in an EGR exhaust manifold 22 and recirculates in an EGR passage 24 to combine with intake flow 28 at a position upstream of or at the an intake manifold 26 of intake system 18. Intake manifold 26 provides a charge flow including the intake flow 28 combined with EGR flow 20. Intake manifold 26 may be connected to an intake passage that includes an intake throttle (not shown)

to regulate the charge flow to cylinders 14*a*, 14*b*. The intake system 18 may also include a charge air cooler (not shown) to cool the charge flow provided to intake manifold 26. The intake system 18 may also include one or more compressors (not shown) to compress the intake air flow 28.

In the illustrated embodiment, the EGR flow 20 returns to the intake manifold 26 directly. In certain other embodiments, the EGR flow 20 may combine with the intake flow 28 at an outlet of EGR passage 24 that is, for example, a mixer or any other suitable arrangement. The EGR system 16 may be a low-pressure loop, for example returning to the intake at a position upstream of a compressor in the intake system, or a high-pressure loop, for example returning to the intake at a position downstream of a compressor and/or at the intake manifold 26. The EGR system 16 may include an EGR cooler (not shown) in the EGR passage 24. In other embodiments, EGR passage 24 can include a bypass with a valve that selectively allows EGR flow to bypass the EGR cooler. The presence of an EGR cooler and/or an EGR cooler bypass is optional and non-limiting. In addition, one or more sensors and/or actuators can be provided in the EGR system 16, such as a binary on/off valve, temperature/pressure sensors, flow control valve, etc.

Non-primary EGR cylinders 14*a* are connected to an exhaust system 30 that includes an exhaust manifold 32 that receives exhaust gases from non-primary EGR cylinders 14*a*, and an exhaust passage 34 that receives exhaust gas from exhaust manifold 32. The exhaust passage 34 can be connected to a turbine (not shown) that is operable via the exhaust gases to drive a compressor, and an aftertreatment system (not shown) in exhaust passage 34 that is configured to treat emissions in the exhaust gas. The turbine can be fixed geometry, a variable geometry turbine with an adjustable inlet, or include a wastegate to bypass exhaust flow. Other embodiments contemplate an exhaust throttle (not shown) in the exhaust system 30.

Figure 2:
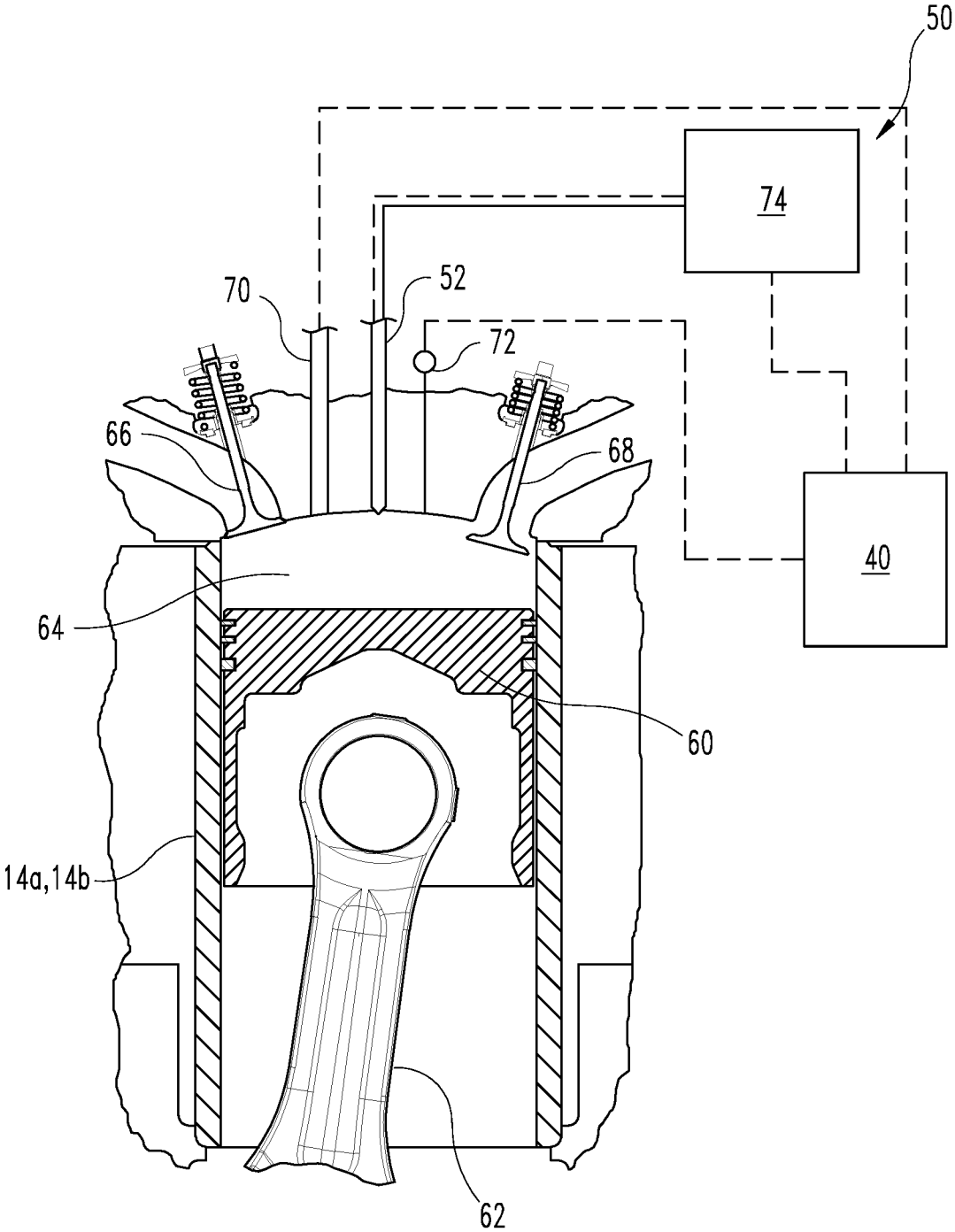
FIG. 2 is a schematic depiction of one embodiment of a cylinder of the internal combustion engine of FIG. 1.

Referring further to FIG. 2, system 10 further includes a fueling system 50 connected to each of the cylinders 14*a*, 14*b*. In certain embodiments, each of the cylinders 14*a*, 14*b* may include a direct injector 52 for providing fuel from fueling system 50. A direct injector, as utilized herein, includes any fuel injection device that injects fuel directly into the cylinder volume, and is capable of delivering fuel into the cylinder. The direct injector may be structured to inject fuel at the top of the cylinder or laterally. In certain embodiments, the direct injector 52 may be structured to inject fuel into a combustion pre-chamber, although in certain embodiments the cylinders 14*a*, 14*b* do not include a combustion pre-chamber. Each cylinder 14*a*, 14*b* may include one or more direct injectors. The direct injectors may be the primary or the only fueling device for the cylinders 14*a*, 14*b*, or alternatively the direct injectors may be an auxiliary or secondary fueling device for the cylinders 14*a*, 14*b*. In certain embodiments, the direct injectors are capable of providing all the designed fueling amount for the cylinders 14*a*, 14*b* at any operating condition. Alternatively, the direct injectors may be only partially capable of providing the designed fueling amount, for example the direct injectors may be capable of providing a designated amount of fuel for a specific purpose, including any purpose described anywhere throughout the present disclosure.

In still other embodiments, cylinders 14*a*, 14*b* include a port injector (not shown) in addition to or alternatively to direct injectors 52. In these embodiments, the port fuel injectors may be positioned such that no other cylinder in the system 10 is downstream of the port fuel injector, i.e. only the target cylinder is downstream of the port fuel injector. Other embodiments contemplate single point injection of fuel.

As shown further in FIG. 2, cylinders 14*a*, 14*b* each include a piston 60 connected to a crank via a connecting rod 62. Piston 60 moves in combustion chamber 64 between a top dead center (TDC) position and a bottom dead center (BDC) position. Cylinder 14*a*, 14*b* includes at least one exhaust valve 66 and at least one intake valve 68 that are operable to selectively open and close an exhaust port and intake port, respectively, in fluid communication with combustion chamber 64. A direct injector 52 is also shown for directing fuel from fuel source 74 directly into combustion chamber 64 in a predetermined pulse amount, width, duration, timing and number of pulses in response to a fueling command from a controller 40. In certain embodiment, cylinder 14*a*, 14*b* may also include a spark plug 70 that ignites the air/fuel mixture in combustion chamber 64 according a spark timing command that times ignition relative the position of piston 60 in combustion chamber 64. In one embodiment, a lambda sensor 72 is connected to or associated with cylinder 14*a*, 14*b* and configured to provide a real or virtual measurement indicative of the air-fuel ratio, or lambda, to controller 40. Direct injector 52, spark plug 70, and/or lambda sensor 72 can be connected to controller 40 to provide outputs to controller 40 and/or to receive commands from controller 40.

In certain embodiments, the controller 40 controls operation of the direct injectors 52 (or port injectors) of cylinder(s) 14*a*, 14*b* in response to determining cylinder deactivation conditions and/or EGR fraction deviation conditions are present to output a fueling command that cuts fueling to one of more of cylinders 14*a*, 14*b* and/or shuts valves 66, 68 to deactivate the corresponding cylinder 14*a*, 14*b*. In certain embodiment, a cylinder deactivation controller can be provided in addition to or as a part of controller 40. The cylinder deactivation can occur in response to, for example, a low load condition for the engine 12 being less than a threshold amount to improve fuel efficiency, a warm up condition, an idle condition, a thermal condition, and/or an NVH management. In addition, the cylinder deactivation can occur to increase or decrease the effective EGR fraction in response to an EGR fraction deviation condition from a nominal EGR fraction (25% in the illustrated 4 cylinder embodiment with one primary EGR cylinder 14*b*).

In certain embodiments, the system 10 includes a controller 40 structured to perform certain operations to control a divided exhaust gas engine such as engine 12. In certain embodiments, the controller 40 forms a portion of a processing subsystem including one or more computing devices having memory, processing, and communication hardware. The controller 40 may be a single device or a distributed device, and the functions of the controller 40 may be performed by hardware or by instructions encoded on computer readable medium. The controller 40 may be included within, partially included within, or completely separated from an engine controller (not shown). The controller 40 is in communication with any sensor or actuator throughout the system 10, including through direct communication, communication over a datalink, and/or through communication with other controllers or portions of the processing subsystem that provide sensor and/or actuator information to the controller 40.

In certain embodiments, the controller 40 is described as functionally executing certain operations. The descriptions herein including the controller operations emphasizes the structural independence of the controller, and illustrates one grouping of operations and responsibilities of the controller. Other groupings that execute similar overall operations are understood within the scope of the present application. Aspects of the controller may be implemented in hardware and/or by a computer executing instructions stored in non-transient memory on one or more computer readable media, and the controller may be distributed across various hardware or computer based components.

Example and non-limiting controller implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

The listing herein of specific implementation elements is not limiting, and any implementation element for any controller described herein that would be understood by one of skill in the art is contemplated herein. The controllers herein, once the operations are described, are capable of numerous hardware and/or computer based implementations, many of the specific implementations of which involve mechanical steps for one of skill in the art having the benefit of the disclosures herein and the understanding of the operations of the controllers provided by the present disclosure.

One of skill in the art, having the benefit of the disclosures herein, will recognize that the controllers, control systems and control methods disclosed herein are structured to perform operations that improve various technologies and provide improvements in various technological fields. Without limitation, example and non-limiting technology improvements include improvements in combustion performance of internal combustion engines, improvements in emissions performance, aftertreatment system performance, engine fuel economy performance, improved durability of exhaust system components for internal combustion engines, and engine noise and vibration control. Without limitation, example and non-limiting technological fields that are improved include the technological fields of internal combustion engines and related apparatuses and systems as well as vehicles including the same.

Certain operations described herein include operations to interpret or determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a non-transient computer readable storage medium, receiving the value as a run-time parameter by any means known in the art, and/or by receiving a value by which the interpreted or determined parameter can be calculated, and/or by referencing a default value that is interpreted or determined to be the parameter value.

Certain systems are described following, and include examples of controller operations in various contexts of the present disclosure. It should be understood that other embodiments contemplate performance of procedure with fewer steps than disclosed herein, with other or additional steps, and/or with steps performed in a different order.

In certain embodiments, a procedure or algorithm for operation of controller 40 is provided. The procedure includes an operation for providing a charge flow to engine 12 having at least one primary EGR cylinder 14*b* connected to EGR passage 24 and a plurality of non-primary EGR cylinders 14*a* connected to exhaust passage 34, passing an exhaust flow from the non-primary EGR cylinders 14*a* through the exhaust passage 34, and passing an EGR flow from the at least one primary EGR cylinder 14*b* through the EGR passage 24 to the intake system 18. The charge flow includes an EGR fraction corresponding to an amount of recirculated exhaust gas in the charge flow from at least the at least one primary EGR cylinder 14*b*. The controller 40 is configured to determine at least one of an EGR fraction deviation condition and a cylinder deactivation condition and, in response to the determining, deactivate the at least one primary EGR cylinder 14*b* and/or at least one of the plurality of non-primary EGR cylinders 14*a*.

In certain embodiments, the controller 40 is configured to, in response to the cylinder deactivation condition, deactivate at least one of primary EGR cylinder(s) 14*b* and/or at least one of the non-primary EGR cylinders 14*a*. In another embodiment, the controller 40 is configured to, in response to the EGR fraction deviation condition, deactivate at least one of the primary EGR cylinder(s) 14*b* and/or at least one of the non-primary EGR cylinder(s) 14*a*. In another embodiment, the controller 40 is configured to, in response to the EGR fraction deviation condition, deactivate the at least one of the non-primary EGR cylinders 14*a*. In yet another embodiment, the cylinder deactivation condition is determined by controller 40 in response to an engine load of engine 12 being less than a threshold amount, or any of the other conditions mention herein.

The EGR fraction deviation condition discussed herein includes any condition that may indicate that the amount of recirculated exhaust gas provided by the EGR flow is terminated, deviates, or is expected to fall significantly above or below the expected EGR fraction. In one embodiment, the expected EGR fraction indicates that portion of the total exhaust flow that is expected to be provided as recirculated exhaust gas in the charge flow by the primary EGR cylinder 14*b* under steady state conditions with all cylinders 14*a*, 14*b* operating in the same manner and without recirculated exhaust gas flow contribution from non-primary EGR cylinders 14*a*. For example, in a 4 cylinder engine with one primary EGR cylinder 14*b*, the expected EGR fraction in the charge flow is ¼ or 25%.

Non-limiting examples of events resulting in EGR fraction deviation conditions include an accelerator tip-out condition, a motoring condition, an accelerator tip-in condition, an engine cranking condition, a motoring condition followed by an accelerator tip-in condition, thermal management conditions, warm-up conditions, NVH conditions, and/or a cylinder deactivation condition. Controller 40 is operable to interpret an EGR fraction deviation condition in response to determining a reduction or increase in the amount of recirculated exhaust gas from the expected EGR fraction, detection of an accelerator tip-in condition, detection of an accelerator tip-out condition, detection of an engine cranking condition, and/or detection of a motoring condition for engine 12, and combinations of these and/or other transient condition indications.

The actual EGR fraction or EGR flow can be determined, for example, by determining the difference between the charge flow at intake manifold 26 and the fresh air intake flow upstream of the mixing location with the EGR flow; a direct measurement or calculation of EGR flow; a direct measurement or calculation of intake flow upstream of the mixing location of EGR flow 20 and intake flow 28 and the combined charge flow downstream of the mixing location; a measurement of $O_2$ levels in the EGR passage 24 and exhaust manifold 32; an estimation/calculation of $O_2$ levels inside the cylinder; a measurement of engine operating conditions from engine sensors 90 indicating the occurrence of likely occurrence of a transient event creating an EGR fraction reduction condition; a determination of accelerator pedal position from accelerator pedal 92; or any suitable EGR flow or EGR fraction determination technique. The charge, intake, and/or EGR flow can be determined by a mass air flow sensor, by calculation using a speed-density approach (charge flow), or any other flow determination technique or device.

The cylinder deactivation condition discussed herein includes any condition that may indicate that one or more of the cylinders 14*a*, 14*b* can be deactivated by cutting fueling to the cylinder, by closing one or more of the intake and/or exhaust valves 66, 68 of the deactivated cylinder(s), and/or by turning off one or more spark plugs.

Figure 3:
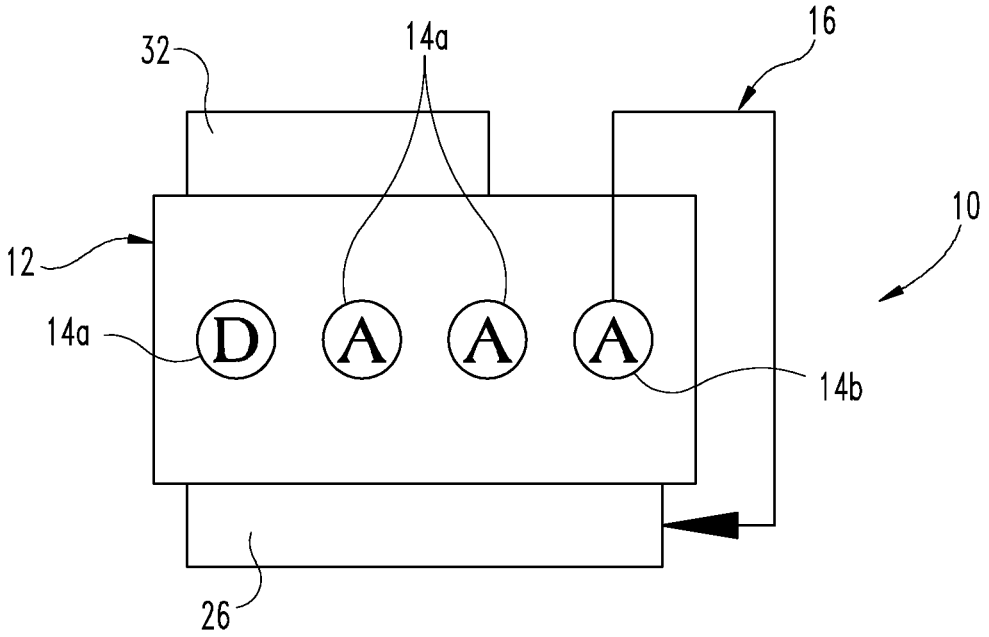
FIG. 3 is a schematic depiction of the engine of FIG. 1 showing one cylinder deactivation condition.

In one embodiment shown in FIG. 3, one of the non-primary EGR cylinders 14*a* is deactivated (indicated by "D", and active cylinders are indicated by "A"), thus increasing the EGR fraction to ⅓ or 33%. The increase in EGR fraction through cylinder deactivation can be provided in response to any condition in which an increase in EGR fraction or compensation for a reduced EGR flow is desired. It is not necessary for all cylinders to operate at the same air-fuel ratio or lambda. For example, the primary EGR cylinder(s) can be operated at a different air-fuel ratio. The increased EGR fraction can provide improved closed cycle efficiency, lower in-cylinder temperature for lower exhaust temperatures and lower NOx emissions, lower knock tendency, control of in-cylinder specific heat, control of in-cylinder composition by adding reformates from the dedicated EGR.

Figure 4:
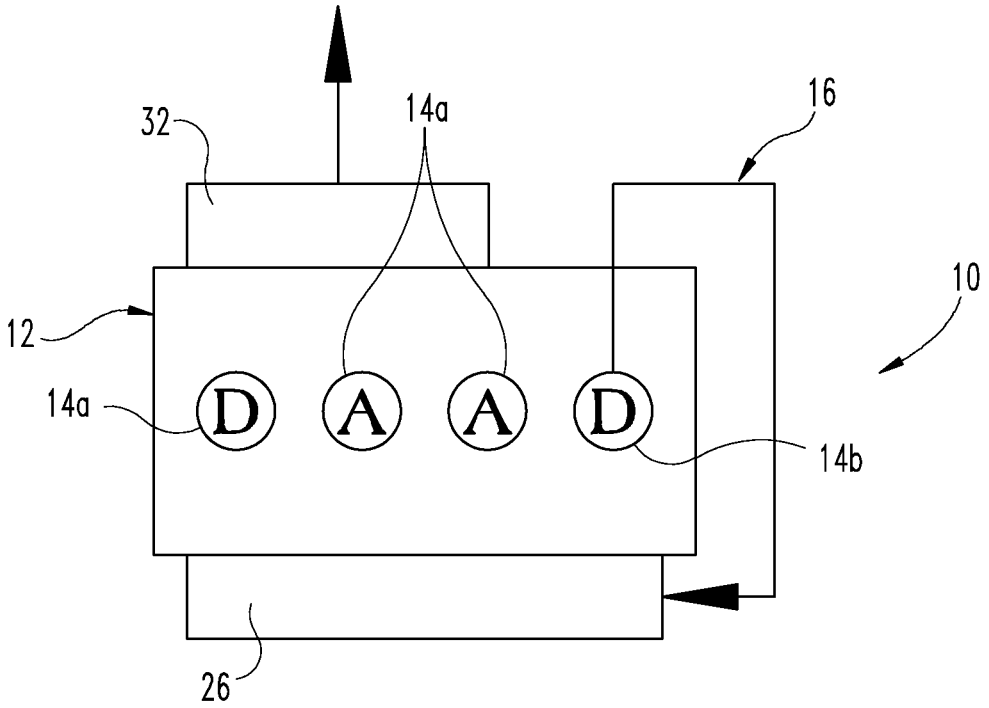
FIG. 4 is a schematic depiction of the engine of FIG. 1 showing another cylinder deactivation condition.

In another embodiment shown in FIG. 4, one of the non-primary EGR cylinders 14*a* is deactivated, and the primary EGR cylinder 14*b* is also deactivated. In this arrangement, no EGR flow is provided, and the resulting EGR fraction is therefore reduced from the nominal EGR fraction to 0%. Two-cylinder operation at lower engine loads provides increased pumping benefits by lower throttling, and also improves thermal efficiency by cylinder deactivation.

Figure 5A:
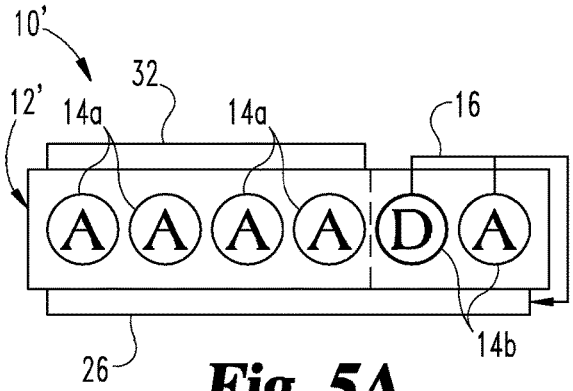
FIGS. 5A-5F are schematic depictions of another embodiment engine showing various cylinder deactivation conditions.

The present disclosure can be applied to engines with more than four cylinders. For example, in FIGS. 5A-5F, another embodiment system 10' is shown that includes an engine 12' with six cylinders. In FIG. 5A, none of the non-primary EGR cylinders 14*a* are deactivated, and only one of the two primary EGR cylinders 14*b* is deactivated. In this arrangement, the resulting EGR fraction is therefore reduced from the nominal EGR fraction to 20%.

Figure 5B:
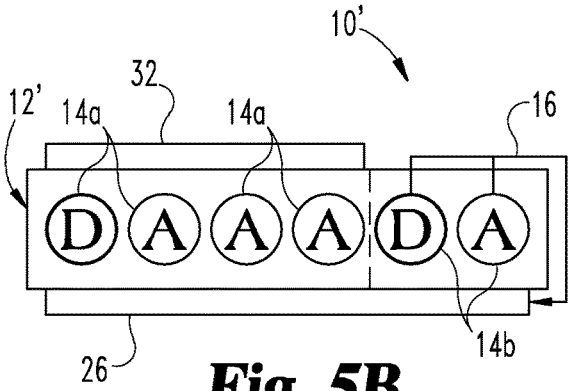
Figure 5C:
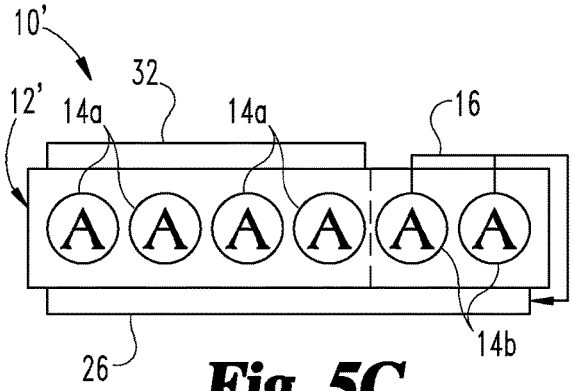

In FIG. 5B, one of the non-primary EGR cylinders 14*a* is deactivated, and only one of the two primary EGR cylinders 14*b* is deactivated. In this arrangement, the resulting EGR fraction is therefore reduced from the nominal EGR fraction to 25%. In FIG. 5C, none of the non-primary EGR cylinders 14*a* are deactivated, and neither of the two primary EGR cylinders 14*b* is deactivated. In this arrangement, with all cylinders active, the resulting EGR fraction is therefore the nominal EGR fraction 33%.

Figure 5D:
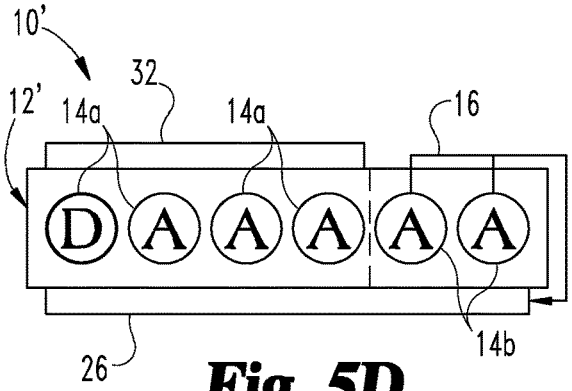
Figure 5E:
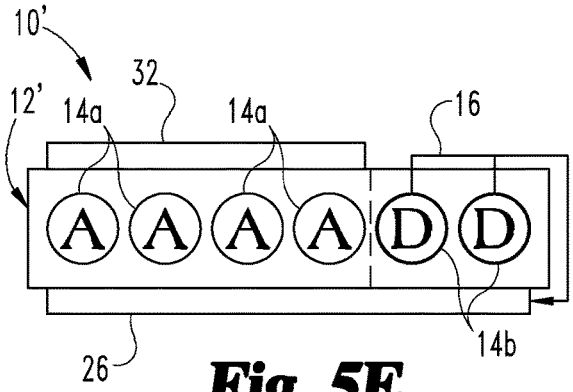
Figure 5F:
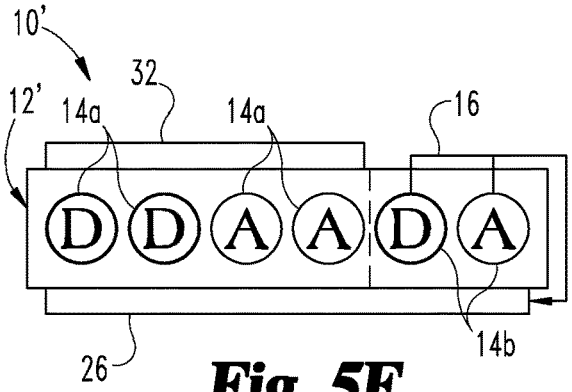

In FIG. 5D, one of the non-primary EGR cylinders 14*a* is deactivated, and neither of the two primary EGR cylinders 14*b* is deactivated. In this arrangement, the resulting EGR fraction is therefore increased from the nominal EGR fraction to 40%. In FIG. 5E, none of the non-primary EGR cylinders 14*a* are deactivated, and both of the two primary EGR cylinders 14*b* are deactivated. In this arrangement, the resulting EGR fraction is 0%. In FIG. 5F, two of the non-primary EGR cylinders 14*a* are deactivated, and only one of the two primary EGR cylinders 14*b* is deactivated. In this arrangement, the resulting EGR fraction is therefore 33%.

Various aspects of the present disclosure are contemplated. According to one aspect, a system includes an internal combustion engine having at least one primary EGR cylinder connected to provide an EGR flow to an EGR passage and a plurality of non-primary EGR cylinders connected to provide an exhaust flow to an exhaust passage. The EGR passage is connected to an intake system to provide an EGR flow from the at least one primary EGR cylinder to the intake system. The intake system provides a charge flow to the at least one primary EGR cylinder and the plurality of non-primary cylinders, and the charge flow includes an intake air flow and an EGR fraction provided by an amount of recirculated exhaust gas from at least the at least one primary EGR cylinder. The system includes a controller configured to interpret a cylinder deactivation condition, and in response to the cylinder deactivation condition the controller is configured to deactivate one or more of the at least one primary EGR cylinder and at least one of the plurality of non-primary EGR cylinders.

In one embodiment, the system includes a fuel system connected by at least one injector to each of the at least one primary EGR cylinder and the plurality of non-primary EGR cylinders, wherein the controller is configured to cut fueling to the deactivated cylinder(s).

In one embodiment, the plurality of non-primary EGR cylinders includes at least two non-primary EGR cylinders and the at least one primary EGR cylinder is a single cylinder.

In one embodiment, the controller is further configured to deactivate the at least one primary EGR cylinder and the at least one of the plurality of non-primary EGR cylinders in response to the cylinder deactivation condition.

In one embodiment, the controller is configured to interpret an EGR fraction deviation condition in which an EGR fraction is to deviate from a nominal EGR fraction, and in response to the EGR fraction deviation condition the controller is configured to deactivate at least one of the plurality of non-primary EGR cylinders. In a refinement of this embodiment, the controller is configured to interpret an EGR fraction deviation condition in which an EGR fraction is to deviate from a nominal EGR fraction, and in response to the EGR fraction deviation condition the controller is configured to deactivate the at least one primary EGR cylinder.

In another aspect, a system includes an internal combustion engine having at least one primary EGR cylinder connected to provide an EGR flow to an EGR passage and a plurality of non-primary EGR cylinders connected to provide an exhaust flow to an exhaust passage. The EGR passage is connected to an intake system to provide an EGR flow from the at least one primary EGR cylinder to the intake system. The intake system provides a charge flow to the at least one primary EGR cylinder and the plurality of non-primary cylinders, and the charge flow includes an intake air flow and an EGR fraction provided by an amount of recirculated exhaust gas from at least the at least one primary EGR cylinder. The system includes a controller configured to interpret an EGR fraction deviation condition, and in response to the EGR fraction deviation condition the controller is configured to deactivate one or more of the at least one primary EGR cylinder and at least one of the plurality of non-primary EGR cylinders.

In another aspect, a method includes providing a charge flow to an internal combustion engine having at least one primary EGR cylinder connected to an EGR passage and a plurality of non-primary EGR cylinders connected to an exhaust passage; passing an exhaust flow from the non-primary EGR cylinders through the exhaust passage; passing an EGR flow from the at least one primary EGR cylinder through the EGR passage to an intake system, the charge flow including an EGR fraction corresponding to an amount of recirculated exhaust gas in the charge flow from at least the at least one primary EGR cylinder; and determining at least one of an EGR fraction deviation condition and a cylinder deactivation condition and, in response to the determining, deactivating the at least one primary EGR cylinder or at least one of the plurality of non-primary EGR cylinders.

In one embodiment, the method includes, in response to the cylinder deactivation condition, deactivating the at least one primary EGR cylinder and the at least one of the non-primary EGR cylinders. In one embodiment, the method includes, in response to the EGR fraction deviation condition, deactivating the at least one primary EGR cylinder and the at least one of the non-primary EGR cylinders.

In one embodiment, the method includes, in response to the EGR fraction deviation condition, deactivating the at least one of the non-primary EGR cylinders. In one embodiment, the method includes, in response to the EGR fraction deviation condition, deactivating the at least one primary EGR cylinders. In one embodiment, the cylinder deactivation condition is determined in response to an engine load being less than a threshold amount.

In one embodiment, with the at least one primary EGR cylinder or the at least one of the plurality of non-primary EGR cylinders being deactivated, the includes deactivating an additional one of the at least one non-primary EGR cylinders or primary EGR cylinders in response to an EGR fraction deviation condition. In one embodiment, with the at least one primary EGR cylinder and/or the at least one of the plurality of non-primary EGR cylinders being deactivated, the method includes activating one or more of the deactivated at least one non-primary EGR cylinders or at least one of the plurality of primary EGR cylinders.

According to another aspect, an apparatus for controlling operation of an internal combustion engine includes a controller configured to interpret an EGR fraction deviation condition in which an EGR fraction provided by an amount of recirculated exhaust gas in a charge flow to a plurality of cylinders of the internal combustion engine deviates from an expected steady state EGR fraction. At least one of the plurality of cylinders is a primary EGR cylinder dedicated to providing an EGR flow and remaining ones of the plurality of cylinders are non-primary EGR cylinders. The controller is further configured to, in response to the EGR fraction deviation condition, deactivate one or more of the non-primary EGR cylinders of the plurality of cylinders, or deactivate the primary EGR cylinder of the plurality of cylinders.

In one embodiment, in response to the EGR fraction deviation condition, the controller is configured to deactivate one or more of the non-primary EGR cylinder and deactivate the primary EGR cylinder.

According to another aspect, an apparatus for controlling operation of an internal combustion engine, includes a controller configured to interpret a cylinder deactivation condition in which one or more of a plurality of cylinders of the internal combustion engine are to be deactivated. At least one of the plurality of cylinders is a primary EGR cylinder dedicated to providing an EGR flow and remaining ones of the plurality of cylinders are non-primary EGR cylinders. The controller is further configured to, in response to the cylinder deactivation condition, deactivate one or more of the non-primary EGR cylinders, or deactivate the at least one primary EGR cylinder.

In one embodiment, in response to the cylinder deactivation condition, the controller is configured to deactivate one or more of the non-primary EGR cylinder and deactivate the primary EGR cylinder.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system comprising:

an internal combustion engine having at least one primary exhaust gas recirculation (EGR) cylinder connected to provide an EGR flow to an EGR passage and a plurality of non-primary EGR cylinders connected to provide an exhaust flow to an exhaust passage, wherein the EGR passage is connected to an intake system to provide an EGR flow from the at least one primary EGR cylinder to the intake system, wherein the intake system provides a charge flow to the at least one primary EGR cylinder and the plurality of non-primary cylinders, the charge flow including an intake air flow and an EGR fraction provided by an amount of recirculated exhaust gas from at least the at least one primary EGR cylinder; and a controller configured to interpret a cylinder deactivation condition, and in response to the cylinder deactivation condition the controller is configured to deactivate one or more of:

the at least one primary EGR cylinder; and at least one of the plurality of non-primary EGR cylinders.

2. The system of claim 1, further comprising a fuel system connected by at least one injector to each of the at least one primary EGR cylinder and the plurality of non-primary EGR cylinders, wherein the controller is configured to cut fueling to the deactivated cylinder(s).

3. The system of claim 1, wherein the plurality of non-primary EGR cylinders includes at least two non-primary EGR cylinders and the at least one primary EGR cylinder is a single cylinder.

4. The system of claim 1, wherein the controller is further configured to simultaneously deactivate the at least one primary EGR cylinder and the at least one of the plurality of non-primary EGR cylinders in response to the cylinder deactivation condition.

5. The system of claim 1, wherein the controller is configured to interpret an EGR fraction deviation condition in which an EGR fraction is to deviate from a nominal EGR fraction, and in response to the EGR fraction deviation condition the controller is configured to deactivate at least one of the plurality of non-primary EGR cylinders.

6. The system of claim 5, wherein the controller is configured to interpret an EGR fraction deviation condition in which an EGR fraction is to deviate from a nominal EGR fraction, and in response to the EGR fraction deviation condition the controller is configured to deactivate the at least one primary EGR cylinder in addition to deactivating the at least one of the plurality of non-primary EGR cylinders.

7. A system comprising:

an internal combustion engine having at least one primary exhaust gas recirculation (EGR) cylinder connected to provide an EGR flow to an EGR passage and a plurality of non-primary EGR cylinders connected to provide an exhaust flow to an exhaust passage, wherein the EGR passage is connected to an intake system to provide an EGR flow from the at least one primary EGR cylinder to the intake system, wherein the intake system provides a charge flow to the at least one primary EGR cylinder and the plurality of non-primary cylinders, the charge flow including an intake air flow and an EGR fraction provided by an amount of recirculated exhaust gas from at least the at least one primary EGR cylinder;

a controller configured to interpret an EGR fraction deviation condition, and in response to the EGR fraction deviation condition the controller is configured to deactivate one or more of:

the at least one primary EGR cylinder; and at least one of the plurality of non-primary EGR cylinders.

8. A method comprising:

providing a charge flow to an internal combustion engine having at least one primary exhaust gas recirculation (EGR) cylinder connected to an EGR passage and a plurality of non-primary EGR cylinders connected to an exhaust passage;

passing an exhaust flow from the non-primary EGR cylinders through the exhaust passage;

passing an EGR flow from the at least one primary EGR cylinder through the EGR passage to an intake system, the charge flow including an EGR fraction corresponding to an amount of recirculated exhaust gas in the charge flow from at least the at least one primary EGR cylinder; and determining at least one of an EGR fraction deviation condition and a cylinder deactivation condition and, in response to the determining, deactivating one or more of the at least one primary EGR cylinder and at least one of the plurality of non-primary EGR cylinders.

9. The method of claim 8, further comprising, in response to the cylinder deactivation condition, simultaneously deactivating the at least one primary EGR cylinder and the at least one of the non-primary EGR cylinders.

10. The method of claim 8, further comprising, in response to the EGR fraction deviation condition, simultaneously deactivating the at least one primary EGR cylinder and the at least one of the non-primary EGR cylinders.

11. The method of claim 8, further comprising, in response to the EGR fraction deviation condition, deactivating the at least one of the non-primary EGR cylinders.

12. The method of claim 8, further comprising, in response to the EGR fraction deviation condition, deactivating the at least one primary EGR cylinders.

13. The method of claim 8, wherein the cylinder deactivation condition is determined in response to an engine load being less than a threshold amount.

14. The method of claim 8, wherein with the one or more of the at least one primary EGR cylinder and the at least one of the plurality of non-primary EGR cylinders being deactivated, deactivating an additional one of the at least one non-primary EGR cylinders or primary EGR cylinders in response to an EGR fraction deviation condition.

15. The method of claim 8, wherein with the one or more of the at least one primary EGR cylinder and the at least one of the plurality of non-primary EGR cylinders being deactivated, activating one or more of the deactivated one or more at least one non-primary EGR cylinders or the deactivated at least one of the plurality of primary EGR cylinders.

16. An apparatus for controlling operation of an internal combustion engine, comprising a controller configured to:

interpret an exhaust gas recirculation (EGR) fraction deviation condition in which an EGR fraction provided by an amount of recirculated exhaust gas in a charge flow to a plurality of cylinders of the internal combustion engine deviates from an expected steady state EGR fraction, wherein at least one of the plurality of cylinders is a primary EGR cylinder dedicated to providing an EGR flow and remaining ones of the plurality of cylinders are non-primary EGR cylinders; and in response to the EGR fraction deviation condition, deactivate one or more of the non-primary EGR cylinders of the plurality of cylinders and deactivate the primary EGR cylinder of the plurality of cylinders.

17. The apparatus of claim 16, wherein, in response to the EGR fraction deviation condition, the controller is configured to simultaneously deactivate the one or more of the non-primary EGR cylinders and the primary EGR cylinder.

18. An apparatus for controlling operation of an internal combustion engine, comprising a controller configured to:

interpret a cylinder deactivation condition in which one or more of a plurality of cylinders of the internal combustion engine are to be deactivated, wherein at least one of the plurality of cylinders is a primary exhaust gas recirculation (EGR) cylinder dedicated to providing an EGR flow and remaining ones of the plurality of cylinders are non-primary EGR cylinders; and in response to the cylinder deactivation condition, deactivate one or more of the non-primary EGR cylinders and the at least one primary EGR cylinder.

19. The apparatus of claim 18, wherein, in response to the cylinder deactivation condition, the controller is configured to simultaneously deactivate one or more of the non-primary EGR cylinders and deactivate the primary EGR cylinder.

* * * * *